US005206484A

United States Patent [19]

Issartel

[11] Patent Number: 5,206,484

[45] Date of Patent: Apr. 27, 1993

[54] GLOW-PLUG HAVING CERAMIC BASE MATRIX AND CONDUCTING ELEMENT DISPERSED THEREIN

[75] Inventor: Jean-Paul Issartel, Annemasse, France

[73] Assignee: Battelle Memorial Institute, Carouge, Switzerland

[21] Appl. No.: 603,395

[22] Filed: Oct. 26, 1990

[30] Foreign Application Priority Data

Nov. 9, 1989 [CH] Switzerland ..... 4043/89

[51] Int. Cl.[5] ..... F23Q 7/22

[52] U.S. Cl. ..... 219/270; 219/553; 123/145 A

[58] Field of Search ..... 219/270, 260–269, 219/552, 553; 123/145 A, 145 R; 361/264–266; 252/512, 518

[56] References Cited

U.S. PATENT DOCUMENTS

| | | | |
|---|---|---|---|
| 3,032,427 | 5/1962 | Klinger et al. | 252/512 |
| 4,107,510 | 8/1978 | Tombs et al. | 219/270 |
| 4,354,964 | 10/1982 | Hing et al. | 252/512 |
| 4,449,039 | 5/1984 | Fukazawa et al. | 219/553 |
| 4,472,209 | 9/1984 | Langerich et al. | 148/13 |
| 4,486,651 | 12/1984 | Atsumi et al. | 219/553 |
| 4,634,837 | 1/1987 | Ito et al. | 219/270 |
| 4,914,751 | 4/1990 | Masaka et al. | 219/270 |
| 4,931,619 | 6/1990 | Ogata et al. | 219/270 |
| 5,086,210 | 2/1992 | Nunogaki et al. | 219/270 |

FOREIGN PATENT DOCUMENTS

| | | | |
|---|---|---|---|
| 335382 | 10/1989 | European Pat. Off. | 219/270 |

*Primary Examiner*—Bruce A. Reynolds
*Assistant Examiner*—John A. Jeffery
*Attorney, Agent, or Firm*—Cushman, Darby & Cushman

[57] ABSTRACT

Durable glow-plugs utilize, for the heating constitutent material of the heater component of ceramic ignition glow-plugs, admixtures comprising a ceramic phase whose thermal expansion factor is substantially equal to that of the insulator components of the plug and, as a homogeneous dispersion therein, a particulate metal conducting phase whose particles are small enough to keep the internal stresses due to any differences in the thermal expansion factors of the ceramic and the metal particles below a limit at which the ceramic phase may crack or fracture.

7 Claims, 1 Drawing Sheet

GLOW-PLUG HAVING CERAMIC BASE MATRIX AND CONDUCTING ELEMENT DISPERSED THEREIN

BACKGROUND OF THE INVENTION

The present invention concerns ignition glow-plugs in which the basic matrix phase of both the conducting and insulating elements is made of a same ceramic, electrical conductivity of the conducting elements being provided by particles of one or more comminuted conductive materials dispersed in said matrix phase. The ignition glow-plugs of this invention are usable as fast response ignition plugs in high-compression thermal engines, e.g. Diesel engines. The invention also deals with a method for fabricating ceramic ignition glow-plugs.

To start high-compression engines under cold conditions, one uses electrical ignition glow-plugs which must reach the operational temperature (1000° C. or more) before the starter motor is switched on. Now, the time required to preheat glow-plugs may last, depending on the outside temperature, from a few seconds to several tens of seconds because the heating element of the plug has a substantial degree of thermal inertia; hence one has sought to reduce the delay as much as possible by using very large heating currents as well as automated systems for controlling this current when the desired temperature is attained, thereby avoiding premature deterioration of the plug. When a glow-plug normally operates under the foregoing conditions, it is subject to high stress and thermal shocks which threaten to prematurely end its operating life.

Moreover, when the motor is in normal operation, the fuel combustion effects in the cylinders followed by the rapid cooling due to the outflow of exhaust gases will also contribute, together with the heat developed by the glow-plug, to generate thermal oscillations which may result in cracking and premature failure of the plug components, especially if the thermal expansion factors of the insulating and conducting components are markedly different from one another.

These problems are mentioned in documents U.S. Pat. No. 4,931,619 and U.S. Pat. No. 4,742,209 (JIDOSHA-HITACHI) in which it is proposed to use a ceramic matrix for making both the electroconducting and insulating portions of the glow-plug. This concept is validated by using an electrically conductive ceramic for making the heater portion of the plug, whereas the insulating portion is made of insulative ceramic. In order to achieve this object practically, the foregoing documents particularly recommend a SiALON type ceramic. This ceramic is normally insulative without additives; it becomes conductive with the addition of a proportion of titanium nitride. In an embodiment of this achievement, SiALON and titanium nitride are sintered together by using, for thermal compaction, sintering aids such as $Y_2O_3$, AlN and $Al_2O_3$.

Document U.S. Pat. No. 4,742,209 further proposes other ceramic types convenient to manufacture glow-plugs, inter alia ceramics that can resist temperatures of 1200° C. These ceramics include conductive types like carbides, borides and nitrides, particularly SiC, and insulative types such as $Si_3N_4$, AlN and $Al_2O_3$.

Also document U.S. Pat. No. 4,486,651 (NIPPON SOKEN) discloses a heating body comprising a conductive mixture of $MoSi_2$ and $Si_3N_4$ bound to an insulating substrate of $Si_3N_4$ or $Al_2O_3$. In an embodiment, the heating body is in the form of an ignition glow-plug.

Document EP-A-335.382 (NIPPON DENSO) discloses ignition glow-plugs of which an embodiment comprises a $Si_3N_4$ insulator substrate and a heating component consisting of an admixture of $Si_3N_4$ in 10 μm particles and $Mo_5Si_3C$ in 1 μm particles. In a particular variant of this embodiment, the insulator substrate also contains a proportion of particulate conductive $MoSi_2$, but the particle size of the $Si_3N_4$ (1 μm) is much smaller than that of the $Si_3N_4$ particles (10 μm) of the conductor element; hence the many $MoSi_2$ particles do not touch one another and the material is not electrically conductive. Notwithstanding, having the two materials, the insulative and the electrically conductive ones, in both the conducting and insulating components of the plug (although the proportion in each are different) will cause the thermal expansion factors in both components to be much alike, which strongly reduces internal stresses with temperature changes.

Also U.S. Pat. No. 4,634,837 (NIPPON SOKEN) discloses sintered ceramic glow-plugs. In an embodiment, the heating component comprises a sintered mixture of $Si_3N_4$ powder and $MoSi_2$ powder the particle size of the former being smaller than the particle size of the latter. The insulating component comprises $Si_3N_4$ and $Al_2O_3$ powders in sintered admixture. It appears clearly from the teaching of this document that for a given fixed weight ratio of conductive ($MoSi_2$) and insulative particles ($Si_2N_4$) in the conducting element of the glow-plug, the effective conductivity will increase in function to the magnitude of the ratio of particle sizes of the $Si_3N_4$ and $MoSi_2$.

The main advantage of the glow-plugs of the aforediscussed prior art is resistance to thermal shock due to admittedly small differences in the thermal expansion factors of the ceramic matrices involved in making the conducting and insulating elements. As mentioned previously, this small difference is due to using for instance a same ceramic base matrix for both the conducting and insulating components, the conducting component (the heating body of the plug) simply comprising, in admixture with the ceramic base, a conductive ceramic in sufficient quantity to assure electrical conductivity and consecutive electrical heating properties by the Joule effect.

SUMMARY OF THE INVENTION

Ceramics of the types used in the aforementioned prior art are quite expensive on both the standpoint of cost of raw materials and sintering processes. The raw materials, e.g. $Si_3N_4$ and $MoSi_2$ are expensive to buy and to mill to the required particulate size and sintering may require drastic conditions such as high temperatures and pressures (hot pressing). These economic problems can be alleviated by using low cost standard base ceramics for the common matrix (i.e. when taken alone the base ceramic will constitute the insulating element of the plug), and conventional metallic powders admixed with the base ceramic for constituting the conducting element of the plug. Prior to these findings, it was not particularly obvious that desirable component parameters required to sufficiently compensate for the differences in properties inherent to metals and ceramics might be achieved. In other words, the invention is directly related to the finding of conditions under which components made of pure insulative ceramics and components of ceramics with admixed metal particles (cermets) can be closely combined together without generating unbearable internal mechanical tensions and stresses with temperature changes. This has been successfully achieved with the glow-plugs defined in the annexed claims.

Briefly summarized, the problems were solved after establishing that durable glow-plugs can be realized by using, for the heating constituent material of the heater component of ceramic ignition glow-plugs, admixtures comprising a ceramic phase whose nature is identical with that of the insulator components of the plug and, as a homogeneous dispersion therein, a particulate metal conducting phase whose particles are small enough to keep the internal stresses due to the differences in the thermal expansion factors of the ceramic and the metal particles below a limit at which the ceramic phase may crack or fracture. It has indeed been noted that the smaller the metal particles embedded in the ceramic phase, the weaker the forces they will exert against the embedding ceramic phase when the plug is subjected to alternate heating and cooling during operation.

On a practical standpoint, when one uses ceramic and metallic phases whose thermal expansion factors are different but where the value of one of these factors does not exceed 3 to 4 fold the value of the other, one can select metallic particles having size of 50 μm or less except in special cases. However since particles of less than 0.1 μm are difficult to make and expensive, it is preferred to use particle sizes above 0.1 μm. Generally, one uses comminuted metallic and ceramic phases having thermal expansion factors in a ratio of from about 1:1 to 3:1, preferably 0.5:1 to 1.5:1 with metallic particles in ranges not exceeding 50 μm, except in special cases. Particles in the range of 0.1–10 μm are especially preferred ones.

In the ceramic phases to be used in the present invention, the preferred ones are Alumina, Cordierite, Mullite, Zircone, $Si_3N_4$ and AlN. In the conducting particulate phases, one can cite Cr, Mo, Ni, Co and W since these metals resist high sintering temperatures in the order of 1200°–1600° C. An advantage of cermets over conducting ceramics of the prior art is that they can be sintered at lower temperatures than that needed for the conducting ceramics and, generally, hot pressing is not necessary to form the sintered glow-plug components.

The following Table provides data on the physical properties of several materials usable in the invention, namely the data include thermal expansion coefficient (Exp.), the melting temperature of the metals to be used in divided form (°C.) and the maximum temperature to which the ceramics can be heated during operation of the glow-plugs. The thermal conductivity in W/M/°K.

| Materials | Exp. ($\times 10^{-6}$) | MP (°C.) | Cond. (W/M/°K.) |
|---|---|---|---|
| Co | 12.5 | 1495 | 69 |
| Cr | 6.2 | 1875 | 67 |
| Mo | 5.1 | 2610 | 136 |
| Ni | 13.3 | 1453 | 83 |
| Pd | 11.6 | 1552 | 75 |
| W | 4.6 | 3387 | 167 |
| $Si_3N_4$ | 3.3 | 1200 | 15–43 |
| SiAlON | 3.3–3.7 | 1200 | 20 |
| $TiO_2$ | 8.8 | — | 5 |
| $ZrO_2$ | 5 | 2200 | 1.3 |
| $Al_2O_3$ | 8 | 1700 | 24–34 |
| AlN | 5.3 | 1200 | 140 |
| Ceramic glass | 13 | 1000 | 1.3 |

It is remarked from the previous data that the thermal expansion of $ZrO_2$ and $Al_2O_3$ ceramics are very near to that of metals such as Mo, Ni and Cr. Hence, in the particular cases where cermets comprising couples of these ceramics and metals are used, the thermally induced stress due to successive alternate heating and cooling strokes is relatively small even if the metal particles have a relatively large size, e.g. up to 500 μm.

In general, in order to assure to the cermets an electrical conductivity in a range sufficient to make fast response glow-plug heating elements, the proportion by weight of the metal powders in the cermet is in the order of 20 to 40%. However, concentrations beyond this range are also possible when taking into account that the finer the metal particles, the better the conductivity for a given fixed weight ratio of metal particles to ceramic. Hence with very fine particles, e.g. between 0.1 and 1 μm, the concentration in the ceramic can be below 20% by weight, approximately in the order of 10–20%.

Preferably, one uses metallic and ceramic phases having thermal expansion factors in a ratio between about 0.5 and 1.5, namely alumina as the insulating ceramic and chromium powder with particles in the range of 0.5–10 μm as the conducting phase; in this case, the proportion of chromium in the alumina can be between about 10 and 40% by weight. In this case, the thermal expansion factor of chromium is about $6\times10^{-6}$/°C. and that of alumina is $8\text{–}8.5\times10^{-6}$/°C. The ratio of both expansion factors is therefore about 0.7 which is relatively low; hence the requirements that the chromium particles be small are less stringent in this case and particles in the average range of 10–50 μm are entirely satisfactory.

It should be noted that the ceramic matrix used in the present glow-plug is not necessarily a pure ceramic of only one kind. Mixtures of two or more ceramics are possible and also mixtures of ceramics and conductive particles insulated from each other. The reason for incorporating a proportion of conductive metallic particles in the ceramic of the insulator components of the glow-plug is to provide thereto a modified expansion coefficient, so that the thermal expansion factors of both the conducting and insulating components of the glow-plug become as close as possible.

In order to insulate conductive particles of comminuted metal, from one another said particles being dispersed in the ceramic phase of an insulator component, one can either space them sufficiently apart to avoid mutual contact, or one may coat them with an insulative film (or a film of low conductivity), e.g., a film of metal oxide. In order to prevent metallic particles from touching each other when dispersed in an insulative ceramic phase by spacing them sufficiently apart, either reduce their concentration below a limit or increase the particle size. Indeed, it has been mentioned already hereinbefore that for a given weight of particles dispersed homogeneously in a carrier phase, the larger the particles, the farther away they stay from one another and the lesser the possibility of mutual contact thereby forming an electrical circuit. On a practical standpoint, it has been experimented in the present glow-plugs that if a quantity in volume of 25% or less of chromium powder with average particle size of about 500 μm is dispersed in alumina, the resulting cermet remains an electrical insulator. With 5 μm particles however, the same proportion will give an electrically conducting cermet. It should be remarked that, in contrast, the thermal properties of both cermets are very similar; consequently, glow-plugs manufactured using the foregoing cermet mixtures (i.e. large chromium particles for the insulator components and small chromium particles for the conductor components) have not only very similar expansion factors but also very similar thermal conductility (that is, upon heating, their temperature will rise substantially parallelwise) which is a strong asset for assuring long life in operation.

Generally speaking, for improving the thermal properties of the insulating ceramic matrix, it is preferred in the present invention to use metal particles superficially insulated by the presence of an insulating film, or a film whose conductivity is at least several orders of magnitude below that of the particle core itself. In these conditions, the particle size is of much lesser importance. The one may in general use the same metals as those which assure electrical conductivity to the heating elements of the plug, namely oxidizable metals such as Co, Cr, Mo, Ni and W, may be used. So, when such metals in powder form are used to modify the thermal properties of the insulating ceramic phase, the particles are coated beforehand with an insulating oxide film by usual means, such as heating in a fluidized bed of oxygen.

Other metals with very high thermal conductivity but less resistant to high temperatures, such as Cu or Ag (the thermal conductility factors of these metals are 393 and 417, respectively) can also be used for the aforementioned purpose. This is, however, under the condition that the ceramic components containing Cu or Ag be not subjected to very high temperatures in operation. This can be so with regard to the insulator component of glow-plugs but only exceptionally with the conductor component the temperature of which generally exceeds 1000° C.

BRIEF DESCRIPTION OF THE DRAWINGS

The invention is illustrated by embodiments of glow-plugs represented in the annexed drawing.

Figure 2:
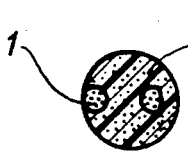
FIG. 2 is a radial cross-section along line II—II of FIG. 1.
Figure 1:
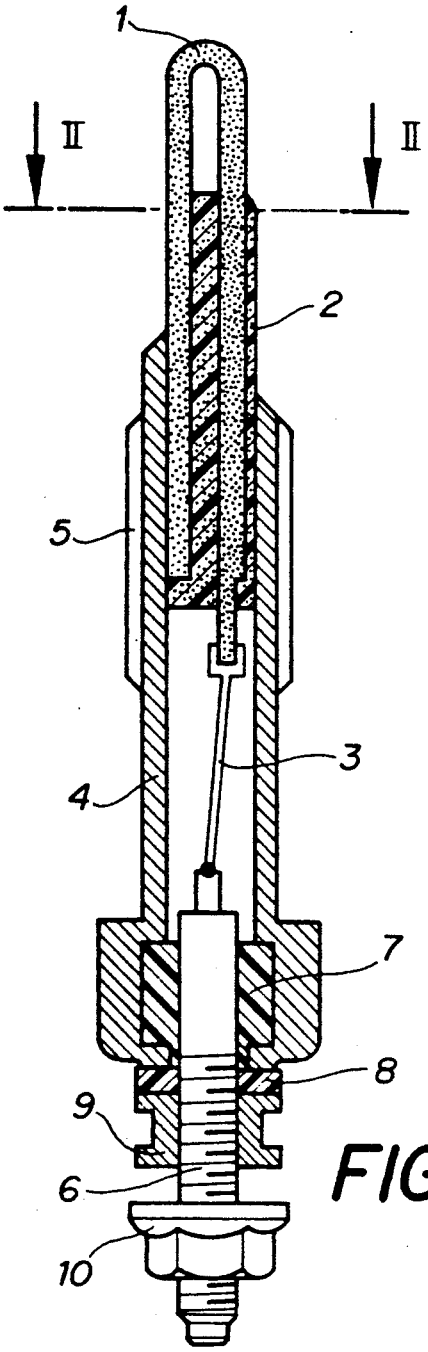
FIG. 1 is a schematic cross-sectional view of a glow-plug according to the invention.

The glow-plug represented schematically in FIG. 1 consists essentially of a heating substrate or body comprising a conductor element 1 and an insulator element 2, both elements being made of a base ceramic matrix of a same nature, e.g. of alumina. The conductor element is made of a cermet of alumina and chromium powder of particle grade 1–5 μm incorporated in the ceramic in a volume proportion of 20–40%. The heating body is provided with a connection wire 3 and it is securely sealed in a tubular casing or socket 4 which also contains threaded portion 5 and an axial threaded rod 6 tightened by an annular gasket 7 of insulating material; the wire 3 is welded to the rod 6 which is also provided, externally to the casing 4, with an insulating washer 8, a nut 9 and a lock-nut 10.

To manufacture the plug, the element 1 of electroconductive cermet is first made by extrusion of a cermet paste as a soft rod which is bent 180° and inserted into a green alumina matrix forming the insulator 2; then the whole cermet-ceramic composite is heated according to usual ceramic making conditions to effect co-sintering of both elements 1 and 2. The sintered heating body is then inserted into casing 4 and fastened therein by usual sealing means (crimping), such that the external surface of element 1 be in positive electrical contact with the inside surface of socket 4. Then the remaining elements of the glow-plug are installed and assembled according to conventional practice.

Naturally, the ceramic of the insulator element 2 of this embodiment can also include, in dispersed form, a thermally conductive additive which imparts thereto enhanced thermal conductivity and reduces the thermal expansion differences between the conductor 1 and insulator 2 elements; this additive can be a proportion of chromium powder, the particles of which are provided with an insulating layer of chromium oxide.

Figure 3:
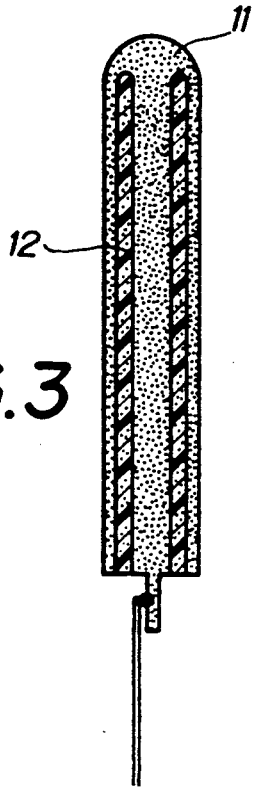
FIG. 3 is a schematic cross-section of a variant of the heating element of the plug of FIG. 1.

FIG. 3 is a schematic cross-section of another embodiment of a heating body to be used in a glow-plug according to the invention. This heating body includes a cermet glowing element 11 and a ceramic insulating element 12. This heating body or substrate can be achieved by first extruding the axial portion of element 11, by coating its peripheral zone with a ceramic layer deposited by dip-coating and, finally, by applying (still by dip-coating) a conductive cermet layer on the whole composite, including the axial face, so as to achieve the device represented schematically in FIG. 3. Then the assembled ceramic and cermet elements are co-sintered as before and the final assembly of the remaining plug elements is brought about as indicated previously.

Figure 4:
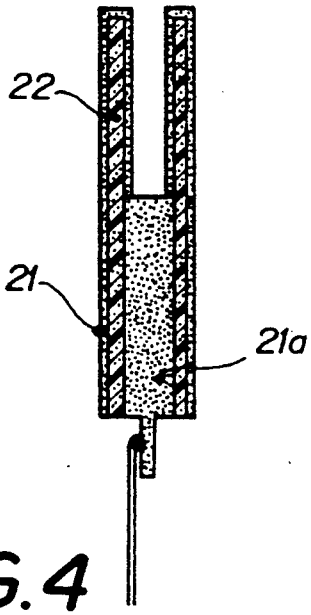
FIG. 4 is a schematic cross-section of another variant of a heating element.

FIG. 4 illustrates schematically another embodiment of a heating body of a glow-plug.

This heating body comprises a ceramic cylinder 22 an end of which is plugged with a cermet stopper 21*a* in contact with a glow element layer 21 deposited by dip-coating on the internal and external walls of the cylinder 22. To manufacture this heating body, a stopper 21*a* of cermet paste is driven into a ceramic cylinder 22 which is thereafter dip-coated with a cermet slurry to achieve the glow layer 21.

The following Examples illustrate the invention.

EXAMPLE 1

In this Example, reference is made to FIG. 3 of the drawing.

In a closed 2 liter polyethylene vessel, the following ingredients were milled for 24 hrs with 1300 g of zirconium silicate balls:

| | |
|---|---|
| Alumina powder (grade about 1 μm) | 810 g |
| Pulverulent vitreous phase containing 80% by weight of $SiO_2$, the remainder being a mixture of MgO, CaO and $Na_2O$ | 90 g |
| Chromium powder (with less than 1% by weight of oxygen) | 674 g |
| Mixture (1:1) of tert.BuOH and petroleum ether | 500 g |
| Fish oil (dispersant) | 22 g |

After milling, the $ZrO_2$ beads were separated from the slurry and the latter was dried into a powder. To 500 g of this dry powder placed in a mixer (DRAIS-IK3) were added 150 g of water and methylcellulose (Methocell®, Dow Chemicals) and the ingredients were agitated under reduced pressure (120 Torr) until a homogeneous doughy slurry was formed (60 min).

The dough was compressed under 3 T/cm$^2$ in order to effect compaction and to remove air bubbles; then it was extruded in a press so as to form an extruded cylinder of 3 mm of diameter. This cylinder was air-dried at 120° C. for 24 hrs.

On the other hand, there was prepared a slurry by admixing 7 g of $H_2O$, 5 g of Methocell ®, 90 g of pulverulent $Al_2O_3$ (grade approximately 1 μm), 10 g of pulverulent vitreous phase (the same phase was used for making the above-disclosed cermet slurry) and 75.4 g of insulated or poorly conducting chromium powder. The particles (10 μm or more) of this chromium powder were insulated by either an oxide layer obtained in a hot oxygen-fluidized bed, or by embedding with $Al_2O_3$.

The dry extruded form was dipped into the suspension so that an approximately 500 μm thick layer of insulating material was deposited thereon. After drying the layer, the axial ends of the form were ground to remove insulation after which the form was again dip-coated (layer of 100–200 μm) with a slurry of cermet material, this slurry containing 90 g of $Al_2O_3$ powder, 10 g of the vitreous phase (described above), 75.4 g of conducting chromium powder (less than 1% by weight of oxygen), 70 g of water and 5 g Methocell ®.

The coated form was dried and one of the terminal faces was ground and machined to provide a bottom connector lug (see FIG. 3); then it was heated to 300° C. (10° C./hr) to evaporate the organic binders. Finally, it was sintered at 1550° C. under normal pressure of Argon, Class 48.

The densified heating body was thereafter sealed into a socket as indicated heretofore, and further metallic parts were assembled therewith so as to achieve a glow-plug which was tested in an engine according to usual testing conditions. This glow-plug gave excellent results in terms of low thermal inertia (working temperature was reached in a few seconds) and service life.

EXAMPLE 2

There was proceeded as in Example 1, with the difference that the chromium powder with insulated particles used for making the insulator component 12 had a mesh grade much coarser (100 μm or more) than the corresponding powder of Example 1. The conductive Cr powder of component 11 was the same as in Example 1. The glow-plug manufactured under these conditions was simpler and cheaper to make than the embodiment of Example 1; nevertheless, its service properties were quite satisfactory.

EXAMPLE 3

In this Example, reference is made to FIG. 4.

A thick extrudable paste was prepared as disclosed in Example 1, but the electroconductive chromium powder used in the formulation was replaced by a chromium powder with high oxygen content (5–10% by weight).

The paste was extruded under pressure to provide an extruded hollow cylinder 22 whose external and internal diameters were, respectively, 8 and 6 mm (length of the cylinder about 25–30 mm). After drying, the cylinder was dip-coated in a cermet slurry (see the cermet slurry formulation disclosed in Example 1) to build an electroconducting layer 21 approximately 200–300 μm thick (measured dry); then a plug 21*a* of cermet paste was driven into one of the cylinder ends and, finally, this end was machined with a grinder so as to clear the corresponding annular zone of the insulating cylinder 22 and provide at the rear of plug 21*a* connecting lug for subsequently connecting the heating element to the axial connector of the glow-plug. After fully drying, the green ceramic-cermet composite was fired and sintered under the conditions disclosed in Example 1. Then the sintered composite was mounted and sealed in a threaded metallic case and the remaining glow-plug elements were assembled together as indicated previously.

This glow-plug provided excellent service under live-test conditions.

Although only a few embodiments have been described in detail above, those of ordinary skill in the art will recognize that modifications are possible without departing from the teachings of the present invention. All such modifications are intended to be encompassed herein.

I claim:

1. Ignition glow-plug for high-compression internal combustion engines, e.g., Diesel motors, said glow-plug having an elongated heating body which protrudes into a combustion chamber of an engine and whose essential components are:

(a) an electrically conducting element, made of a sintered mixture of ceramic and an electrically conducting phase homogeneously dispersed therein, and having two ends, a first one of which is internally connected to an axial terminal of the glow-plug for supplying ignition current thereto, and a second end of said electrically conducting element is connected to an external metallic case of the glow-plug to be screwed in said engine; and (b) an insulating supporting substrate element made of insulative ceramic integral with said electrically conducting element and sealed in said metallic case, characterized in that said electrically conducting element (a) is made of a cermet material of which the ceramic base matrix is of a same nature as the ceramic of said insulating element (b) and said conducting phase dispersed uniformly and homogeneously therein is a particulate metallic phase whose thermal expansion factor differs by no more than four times the thermal expansion factor of the ceramic base matrix in which said particulate metallic phase is dispersed and the particles of which have a size sufficiently small to keep the internal stress forces that result from the thermal variations undergone by the glow-plug in operation below the limits where cracking of the ceramic may occur.

2. The glow-plug of claim 1, in which the ratio of the thermal expansion factors of the conducting metallic phase and of the ceramic matrix is from 1:1 to 3:1 and the particle size is from 0.1 to 50 μm.

3. The glow-plug of claim 1, in which the ratio of the thermal expansion factors of the metallic phase and the ceramic is from 0.5:1 to 1.5:1 and the size of the particles does not exceed 50 μm.

4. The glow-plug of claim 3, in which the metallic phase is chromium powder and the ceramic matrix is alumina.

5. The glow-plug of claim 2, in which the metallic phase is selected from pulverulent Cr, Mo, Ni, W and Co and the ceramic matrix is selected from $Al_2O_3$, Cordierite, Mullite, Zircone, $Si_3N_4$, AlN and SiC.

6. The glow-plug of claim 1, in which said insulating supporting substrate element comprises, homogeneously dispersed therein, additives having high thermal conductivity so as to raise the thermal conductivity of said insulating element to a value near that of the electrically conducting element.

7. The glow-plug of claim 6, in which said additives are selected from powders of Co, Cr, Mo, Ni and W, said powders having particles coated with an insulating film having low electrical conductivity properties.

* * * * *